United States Patent [19]

Kochanneck

[11] 4,039,089

[45] Aug. 2, 1977

[54] RADIAL VEHICLE PARKING APPARATUS WITH A PLURALITY PARKING MACHINES

[76] Inventor: Uwe Kochanneck, 81, Neuer Graben, Dortmund, Germany

[21] Appl. No.: 669,383

[22] Filed: Mar. 22, 1976

Related U.S. Application Data

[63] Continuation of Ser. No. 450,712, April 29, 1974, abandoned.

[51] Int. Cl.[2] ..... E04H 6/06

[52] U.S. Cl. ..... 214/16.1 A; 214/16.1 CA

[58] Field of Search ..... 214/16.1 R, 16.1 A, 214/16.1 C, 16.1 CA

[56] References Cited

U.S. PATENT DOCUMENTS

| | | | |
|---|---|---|---|
| 1,925,442 | 9/1933 | Fournier | 214/16.1 A |
| 2,691,448 | 10/1954 | Lontz | 214/16.1 A |
| 3,437,218 | 4/1969 | Hagel | 214/16.1 A |
| 3,664,523 | 5/1972 | Hagel | 214/16.1 A |

FOREIGN PATENT DOCUMENTS

| | | | |
|---|---|---|---|
| 1,389,741 | 1/1965 | France | 214/16.1 A |

*Primary Examiner*—Robert J. Spar
*Assistant Examiner*—R. B. Johnson
*Attorney, Agent, or Firm*—Michael J. Striker

[57] ABSTRACT

An automatic high garage with a plurality of parking levels and parking spaces arranged in a circle. Within the enclosed circle are one or more automated car parking machines carrying out the parking operations. The parking spaces are constructed as pairs of outward-sloping tracks. The tracks transfer their total loads to triangularly-positioned vertical supports. A vertical column erected in the center of the high garage serves as central supporting element for the roof construction as well as for guiding the parking machines. The cars to be parked are conveyed manually and taken over by an automatic retrieval unit running under the cars.

6 Claims, 9 Drawing Figures

IV
19
18
15
17
21'
V
V
20
14
10
5
32
31
24
35'
26
25
35
8
30''
30
7
27'
27''
28
9
29
10
21
30'
VII
VII
24'
8''
8'
13
11
12
IV 39
36
7
37

RADIAL VEHICLE PARKING APPARATUS WITH A PLURALITY PARKING MACHINES

CROSS-REFERENCE TO RELATED APPLICATION

The present application is a continuation of my prior application Ser. No. 450,712, filed Apr. 29, 1974, now abandoned.

BACKGROUND OF THE INVENTION

The present invention relates to an automatic high garage with a plurality of parking levels and parking spaces arranged in a circle. In this high garage the cars are parked and retrieved by automatic parking machines.

Nowadays, in most cases the parking of cars is effected by the respective driver himself who chooses a free lot, i.e., space, on a parking level within concrete constructions. These concrete constructions are very expensive to construct and they need an unfavourable large total floor space in relation to the real effective parking area efficiency. The finding of free lots within the respective parking level is time-consuming and causes an increased exhaust gas output resulting from driving in low gear. The construction of automated car parking garages has been tried without success, resulting in even higher building expenses, still fewer numbers of parking spaces or in an insufficient car turnover in relation to concrete constructions where cars are parked manually.

SUMMARY OF THE INVENTION

The object of this invention is to develop a high garage of the above mentioned nature, which can be designed economically with optical space efficiency using standard components of mechanical engineering, steel, or reinforced precast concrete industries, controlled fully-automatic or semi-automatic and guaranteeing a great exchange of parked cars.

This and other aims and features of the present invention will become more apparent upon a consideration of the following description in connection with the accompanying drawings, wherein:

DESCRIPTION OF THE PREFERRED EMBODIMENTS

Figure 1:
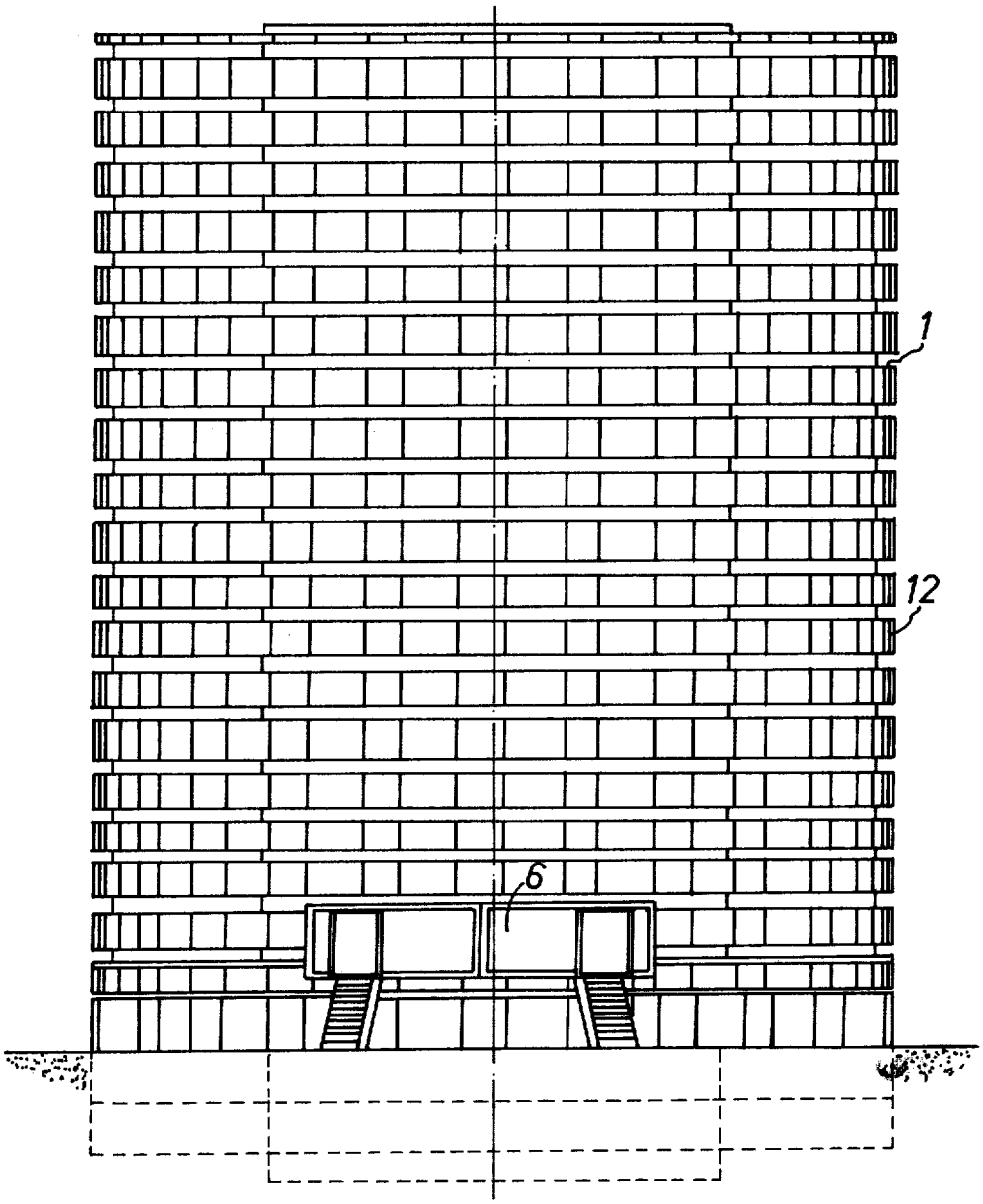
FIG. 1 is the front elevation of an automatic high garage in accordance with the present invention.
Figure 2:
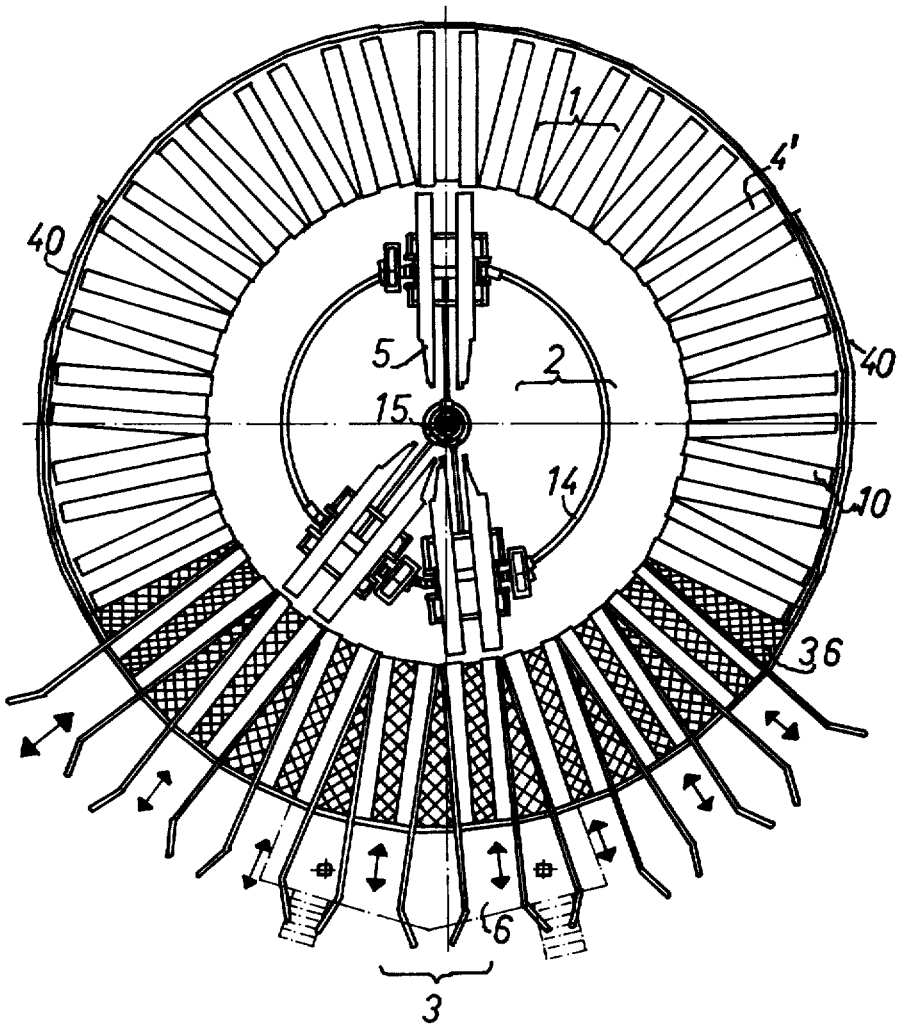
FIG. 2 is a plan view of the high garage at the level of the entrance and exit lots of the cars.
Figure 3:
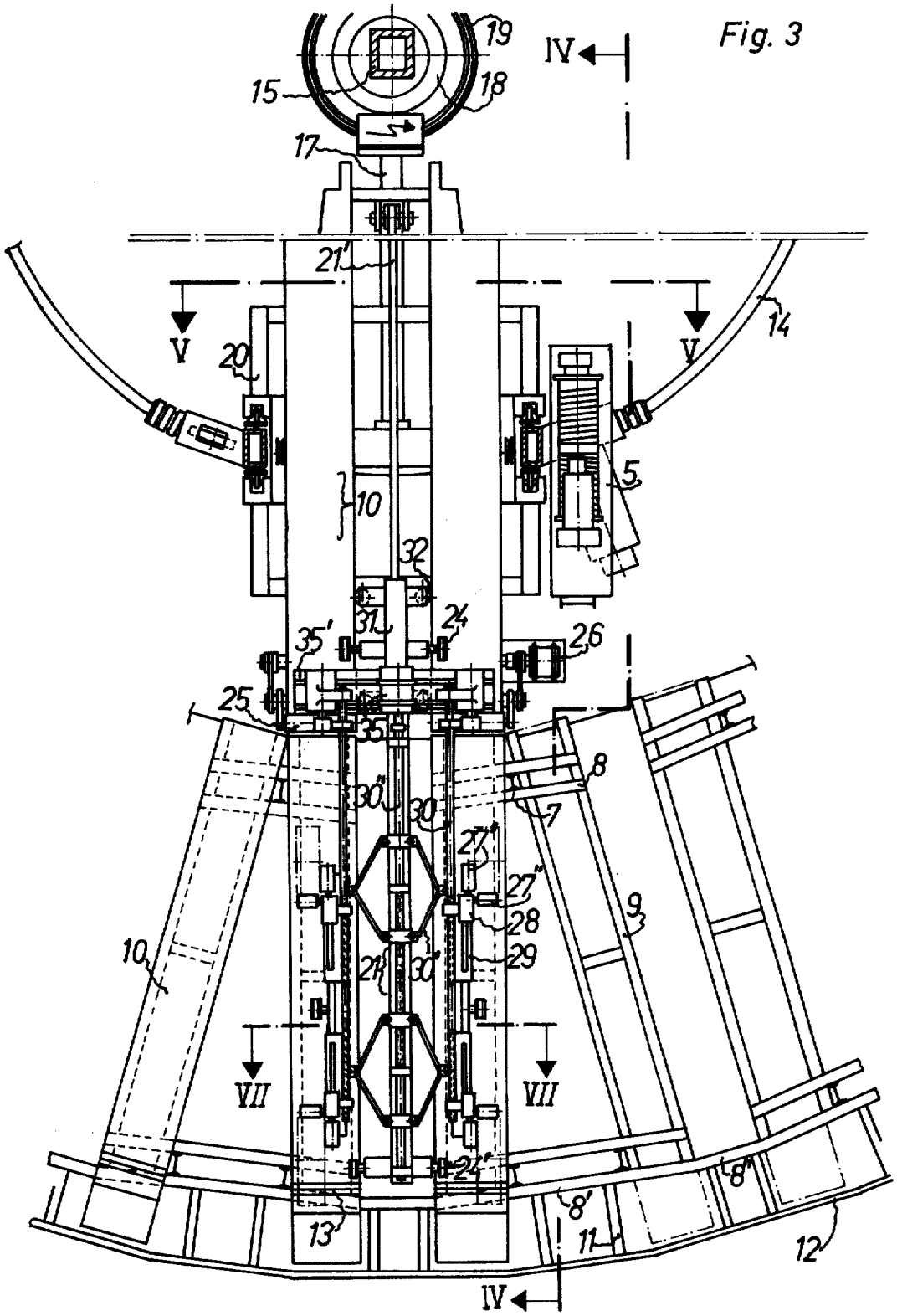
FIG. 3 is a segment sector of a high garage in plan view with parking machine shown.
Figure 4:
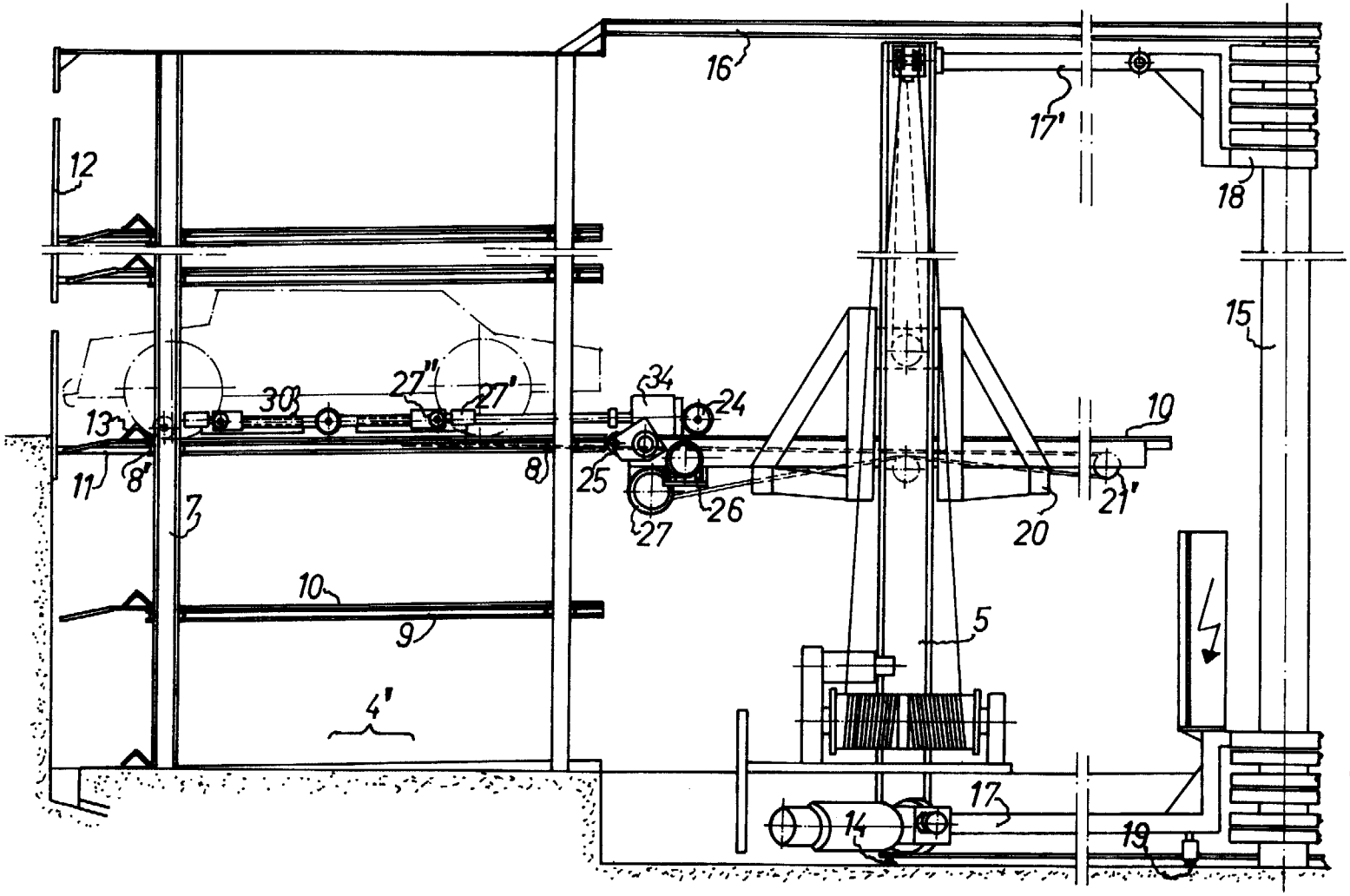
FIG. 4 is a section on line IV—IV across the segment sector of FIG. 3.
Figure 5:
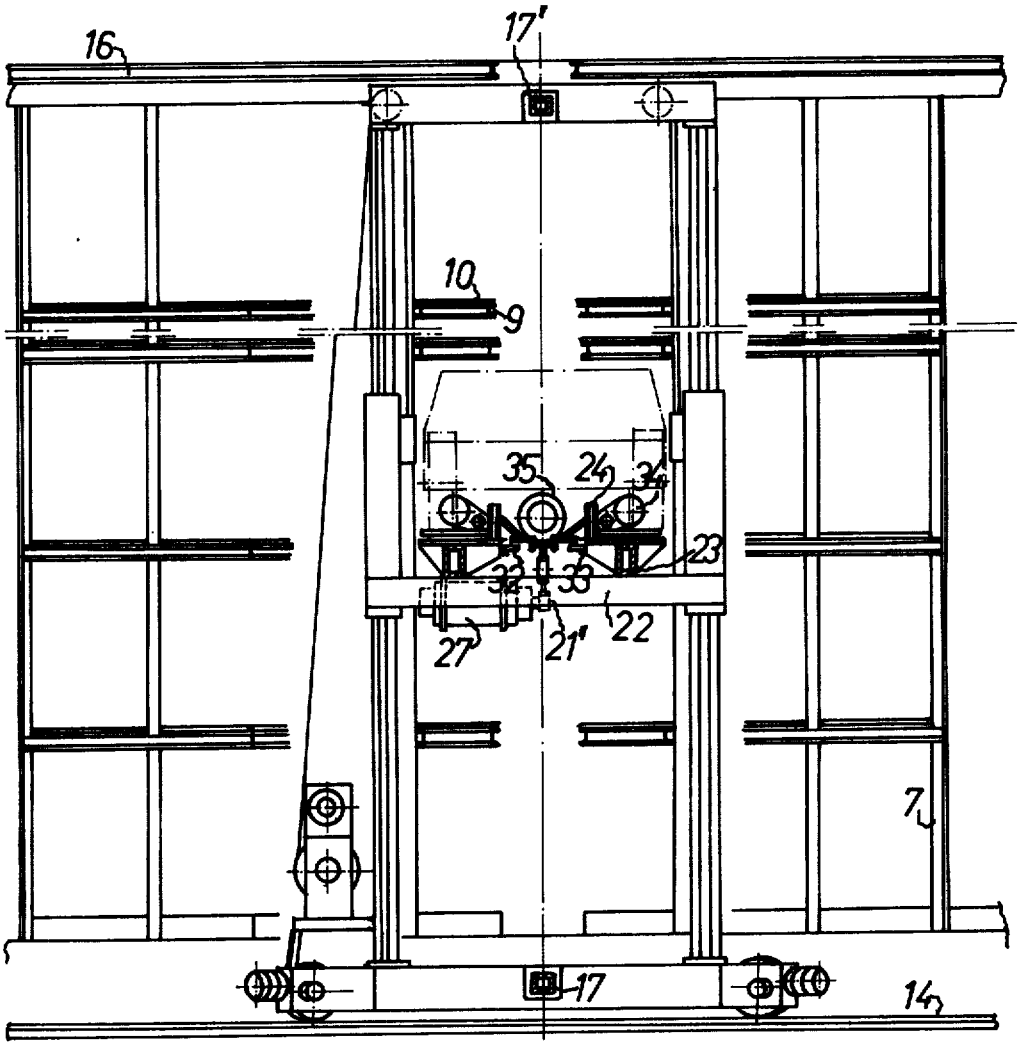
FIG. 5 is a section on line V—V across the segment sector of FIG. 3.
Figure 6A:
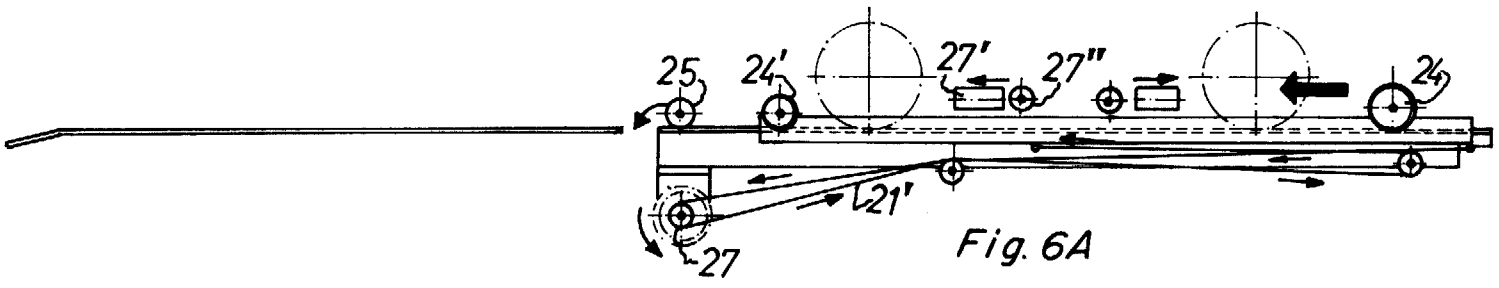
FIGS. 6A, 6B and 6C show the function principle of a retrieval unit in accordance with the present invention.
Figure 6B:
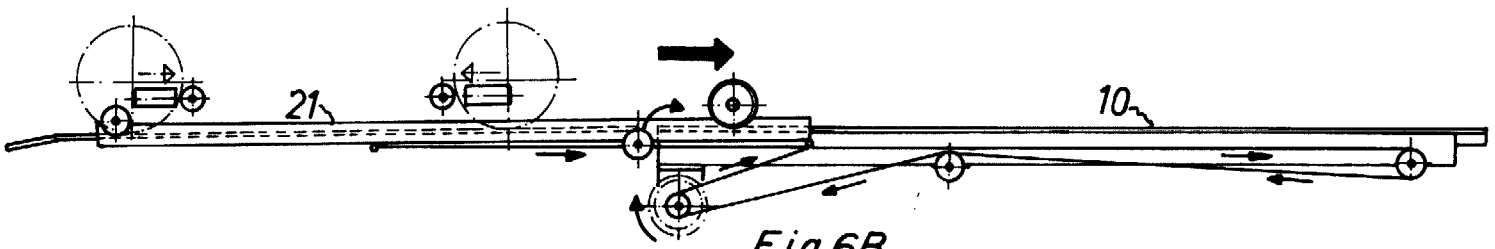
Figure 6C:
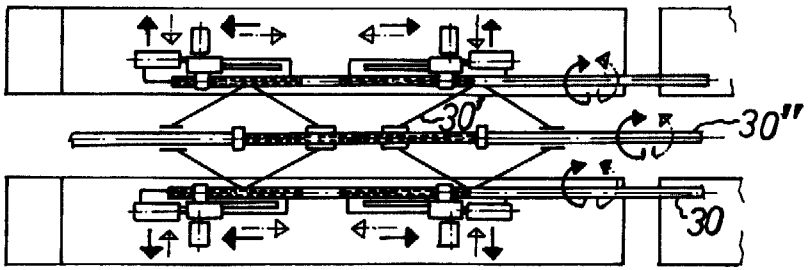
Figure 7:
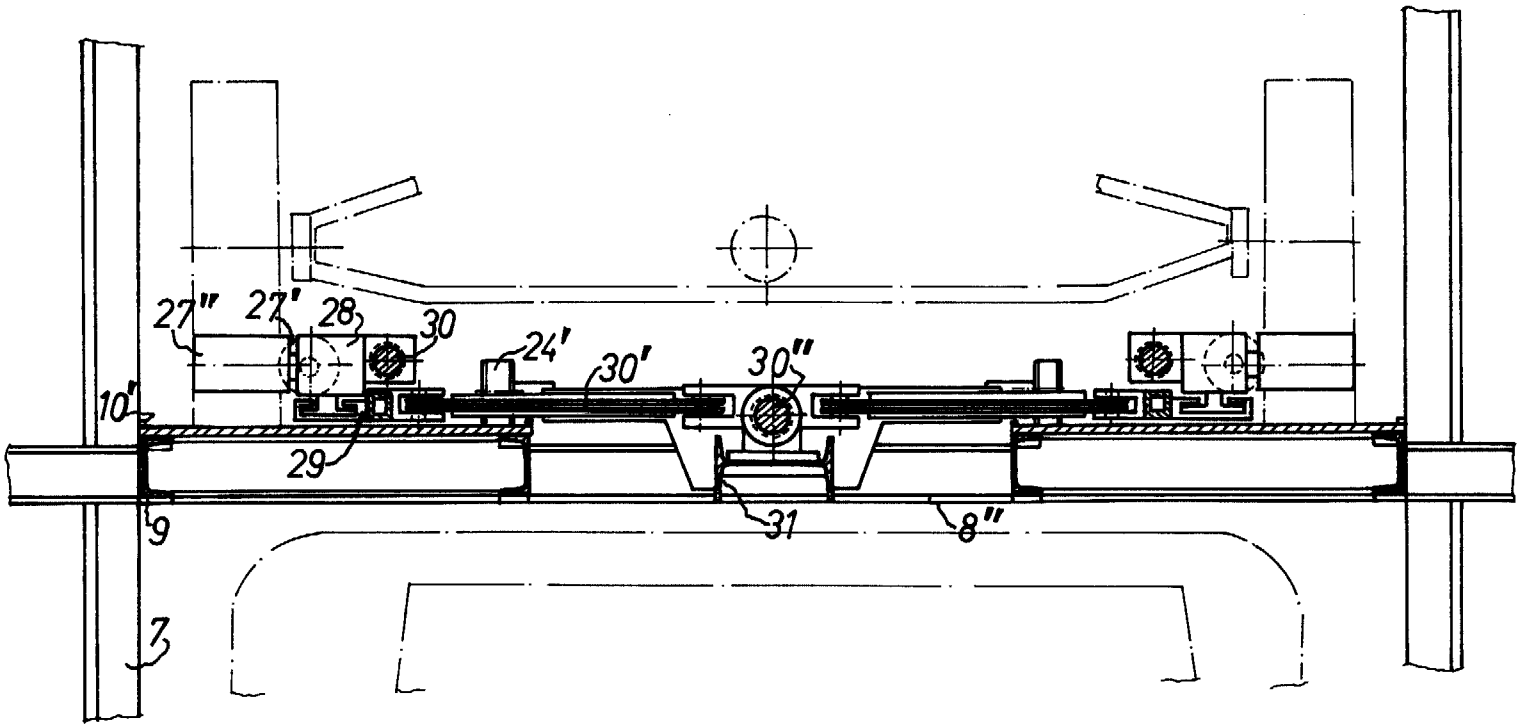
FIG. 7 is a section on line VII—VII across the segment sector of FIG. 3.
Figure 8:
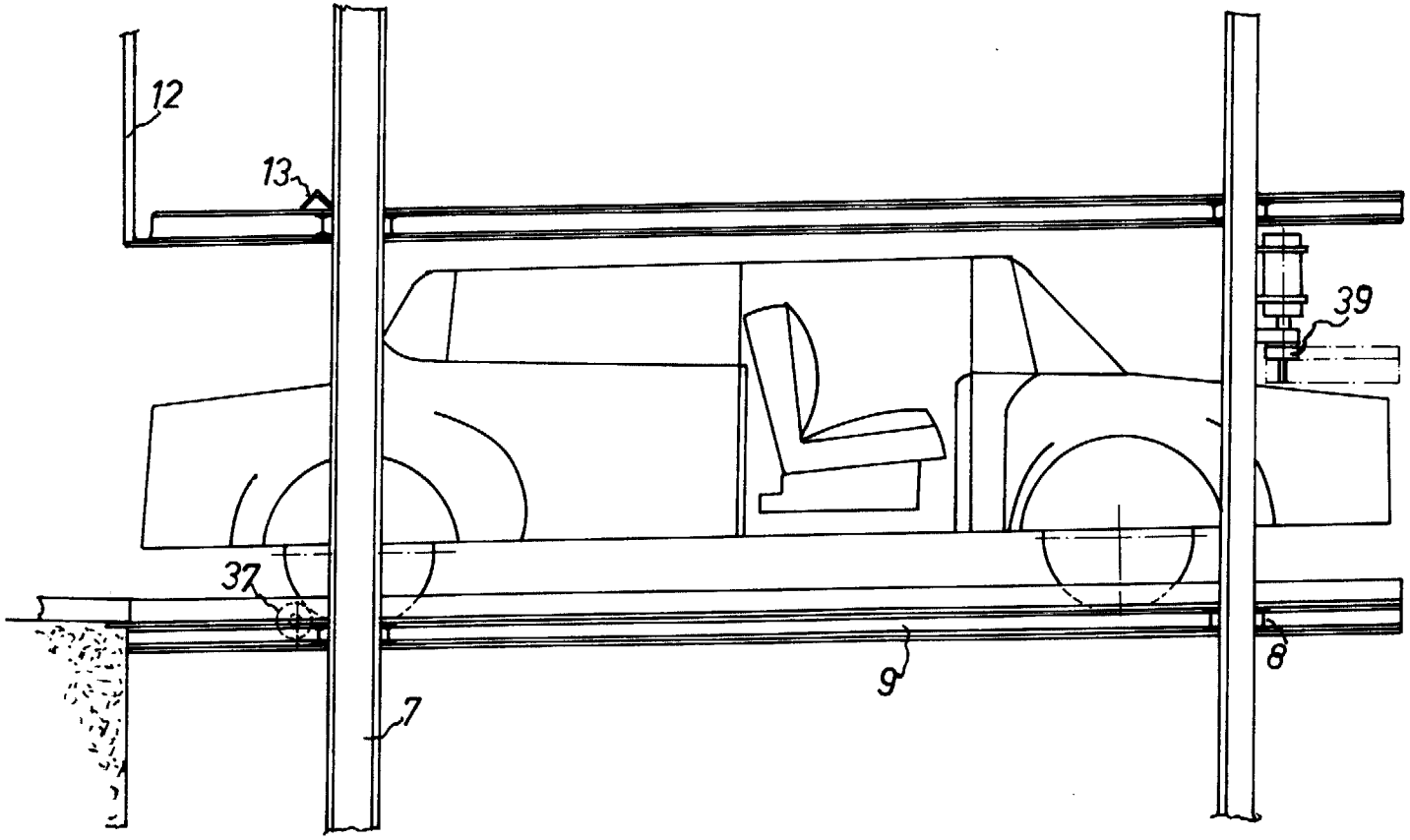
FIG. 8 shows an entrance or exit lot, respectively.
Figure 9:
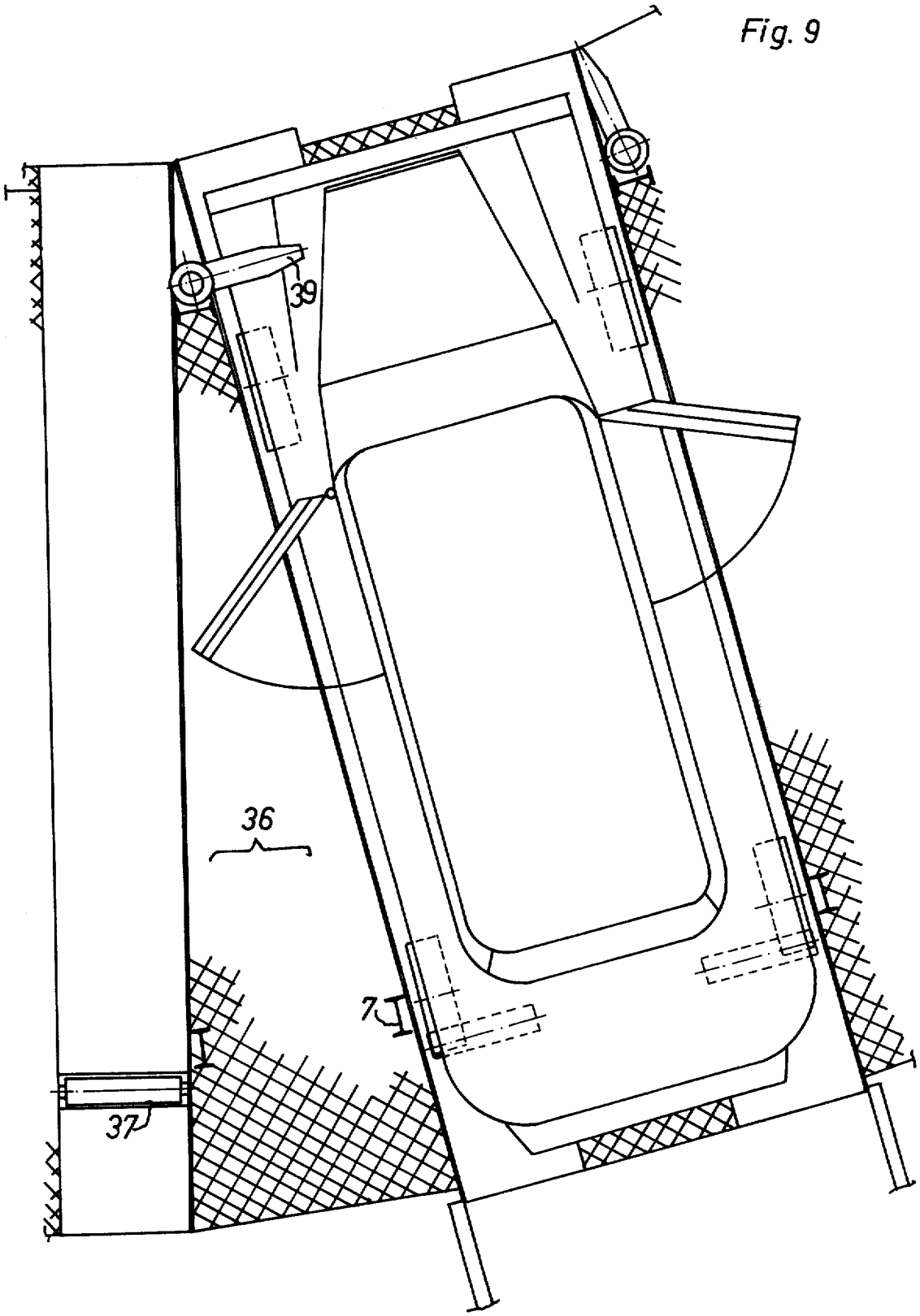
FIG. 9 is the plan view of an entrance or exit lot, respectively, according to FIG. 8.

The circular high parking garage of FIGS. 1–9 comprises, within its periphery, several parking levels 1. The circle confined by the parking levels 1 represents the operating zone 2. There are twenty parking levels 1 one above the other. Each parking level 1 accommodates 25 cars. The cars are conveyed by manually driving them to the entrance and exit zone 3. Afterwards, they are fed by the parking machines 5 to the free parking lots 4' of one of the parking levels 1. The parking machines 5 operate automatically inside the oerating zone 2. The control-commands to the parking machines 5 for parking and retrieval operations are transmitted from a control center 6 which is placed at the front of the complete building. The control is effected by keyboard, punched cards or a computer. The multilevel parking lots 4' transfer their load reactions to the foundation through vertical supports 7. Always three supports 7 constitute a triangular frame with cross beams 8 and longitudinal beams 9 carrying tracks 10 resistant to deflection and forming the driveways for the cars. The ring beams 8' with mounting beams 8'' constitute a closed circle around the parking levels 1. Wall strip panels 12 are mounted on the ring beams 8' and mounting beams 8'' by means of lateral braces 11. The tracks 10 are inclined towards the wall strip panels 12 and in their rear points are mounted drive limit stops 13. The lateral outer edges of the tracks 10 have an edge 10' to discharge drip-water from the parked car (FIG. 7). This ensures a water flow off in direction to the wall strip panels 12. The parking machines 5 run on a circular floor rail 14 and can reach every parking lot 4,4' within the entire high garage. The parking machines 5 are guided by one center column 15 and they transfer their effective horizontal forces to the center column 15 through booms 17, 17'. The center column 15 constitutes also the central supporting element for the roof construction 16. The booms 17, 17' are mounted on slewing rings 18 on the central column 15. The booms 17, at the level of the parking machine floor-beams serve also as cable bridges for the main current from slip-ring elements 19 and for control-impulse cables. Each parking machine 5 is equipped with a load table unit 20. It comprises a base frame 22 which carries two load girders 23 with mounted tracks 10 resistent to deflection as driveways for the cars, similarly to the parking lots 4, 4'. The retrieval unit 21 moves horizontally for the parking and retrieval operations of cars. It is driven by a chain drive 21' and runs with four plastic rollers 24, 24' on the tracks 10. Preceding the extending action of the retrieval unit 21, swing in intermediate rollers 25 by means of a driving motor 26. The intermediate rollers 25 bridge the safety gap between the tracks 10 of the parking lots 4, 4' and the tracks 10 of the parking machines 5. The retrieval unit 21 moves under the cars by means of the driving motor 27 and the chain drive 21'. There are always joined in a bearing block 28 one guide roller 27' and one driving roller 27''. The bearing blocks 28 are adjusted by two threaded rods 30 in longitudinal direction corresponding to the respective wheel position of the cars to be parked. For this purpose, the bearing blocks 28 slide in slotted links 29. Universal joints 30' connect the slotted links 29 with the main girder 31 of the retrieval unit 21. The slotted links 29 with bearing blocks 28 are width-adjusted by a threaded rod 30'' corresponding to the respective track dimension of the cars to be parked. The front part of the main girder 31 carries moreover two brackets with mounted plastic rollers 24'. These plastic rollers 24' run on the tracks 10 of the parking spaces 4, 4'. The rear of the main girder 31 is guided within guide profiles 33 by means of four guide rollers 32. This part of the retrieval unit 21 is not covered by the cars to be parked, therefore it carries the two driving motors 34 of the threaded rods 30 and the driving motor 35 of the threaded bar 30''. During the width-adjustment of the slotted links 29 with bearing blocks 28 and guide and driving rollers 27', 27'' the driving motors 34 slide within the slotted link 35'. The slotted link 35' is rigidly connected with the main girder 31. If the retrieval unit 21 is extended, the plastic rollers 24' are on the tracks 10 of the parking lots 4, 4', whereas the plastic rollers 24 remain on the tracks 10 of the parking machines 5. The parking machines 5 are otherwise constructed as two-mast stacker cranes.

The preparation of the cars to be parked is effected within the parking lots 4 of the entrance and exit zone 3 by manual driving of the cars onto the parking lots 4, that means by the individual driver himself. The triangular spaces 36 between the tracks 10 are covered with grids to ensure that it is safe to place the cars in position and leave them, as well as for the reverse operation of driving out the cars. The parking lots 4 of the entrance and exit zone 3 differ moreover from the parking lots 4' because, at the former are installed two rollers 37 in the tracks 10 instead of rigidly mounted drive limit stops 13. When the rear wheels of the cars run over the rollers 37 an optical signal is actuated. In addition a drive limit bar 39 is mounted at the vertical supports 7. The drive limit bar 39 swivels by means of an electro-mechanical drive. The entrance openings of the parking lots 4 are closed by a two-piece sliding door 40. Parking and retrieval operations are executed as follows: The cars to be parked are driven to the parking lots 4 of the entrance and exit zone 3, running onto the tracks 10. After the rear wheels have run over the rollers 37 a contact between the rollers 37 and the rear wheels is ensured by the slope of the tracks 10, this guaranteeing a safe stop of the cars. The driver leaves the automatic high garage by stepping over grids of the triangular free spaces 36. The most favourably placed parking machine 5 relative to the preselected free parking lot 4' is chosen from the control center 6 by means of a "tell-tale" light panel indicating the movements of the parking machines 5, or a parking lot 4' and charging machine 5 is determined by a computer optimiser after a button is pressed. The selected parking machine 5 moves to the parking lot 4. The drive limit bar 39 is slewed through 90° and the two intermediate rollers 25 are lowered. The retrieval unit 21 is extended under the car towards the parking lot 4. If the retrieval unit 21 is extended the four guides and driving rollers 27' 27'' in moved-together position are driven apart in direction to the wheel base and wheel track. The car is now carried by the driving rollers 27'' and guided by the guide rollers 27' drawn onto the tracks 10 of the parking machine 5. After that the intermediate rollers 25 are again lowered. The retrieval unit 21 pushes the car onto the tracks 10 of the selected parking lot 4' up to the drive limit stop 13. The guide and driving rollers 27', 27'' are again moved together and the last control impulse of the automatic controller installed in the parking machine 5 gives the driving motor 27 a command for retracting the retrieval unit 21, as well as the actuating impulse for the retraction of the intermediate rollers 25.

The cycle described presupposes that the lifting of table unit 20 and the parking machine 5 travel, as well as the positioning procedures, have been completed. After the cycle, the parking machine 5 is available for a new parking operation.

While the invention has been described and shown with particular reference to the preferred example, it will be apparent that variations might be possible that would fall within the scope of the present invention which is not intended to be limited, except as defined in the following claims.

What is claimed is:

1. An automatic high garage, comprising upright support means forming a plurality of vertically superposed parking levels; a plurality of pairs of parking tracks forming at each of said levels an annulus of parking spaces, the parking tracks of each pair having inner end portions and also having outer end portions facing outwardly of the respective annulus and said tracks sloping in direction towards said end portions; limit means at said end portions for preventing vehicles from moving beyond the latter; and parking means within the space defined by said annuli for parking vehicles on and retrieving them from the respective parking spaces, said parking means comprising a circular rail in said space, a central upright column, a plurality of parking machines travelling along said rail and guided by said column, each of said parking machines comprising a load table unit having a base frame and a pair of transfer tracks carried by the same and adapted to support a vehicle, each of said parking machines comprises a retrival unit for transferring vehicles between respective parking and transfer tracks, said transfer tracks extending substantially radially of said annulus and having outer ends adapted to be aligned but forming a gap with said inner end portions of respective pairs of said parking tracks for transfer of a vehicle between the respective aligned parking tracks and transfer tracks, intermediate rollers mounted to be raised into and lowered out of the respective gap, and means for raising and lowering said rollers.

2. An automatic high garage as defined in claim 1, wherein said parking machines are constructed as two-mast stacker cranes.

3. An automatic high garage as defined in claim 1, wherein said retrieval unit is adapted to travel beneath the respective tracks and including rollers engaging the same, a chain drive driving said rollers, and a motor operating said chain drive.

4. An automatic high garage as defined in claim 3, wherein said rollers comprise a set of four guide rollers and a set of four drive rollers, universal joints mounting said rollers; said retrieval unit further comprising means for adjusting the spacing between the rollers of the respective set to the wheel track and wheel base of a vehicle.

5. An automatic high garage as defined in claim 1, said upright support means having an ingress and egress for vehicles; and further comprising control center means outside said support means above said ingress and egress so as not to interfere with vehicle movement, said control center means being operative for controlling the operation of said parking machines.

6. An automatic high garage as defined in claim 5, wherein said ingress and egress is located at street level; and further comprising ingress and egress parking spaces at said street level which define between themselves triangular spaces for drivers leaving and entering vehicles in said ingress and egress parking spaces including limit rollers engageable by the vehicle wheels when a vehicle is fully positioned on the respective space, optical signaling means for providing a signal in response to such engagement, and an electro-mechanical limit bar pivotable to and from a horizontal position in which it prevents vehicles from overshooting the respective inner ends of said ingress and egress parking spaces.

* * * * *